US009211429B2

(12) United States Patent
Heinrich

(10) Patent No.: US 9,211,429 B2
(45) Date of Patent: Dec. 15, 2015

(54) JUMP HOOP DEVICE

(76) Inventor: Carl C. Heinrich, Bozrah, CT (US)

( * ) Notice: Subject to any disclaimer, the term of this patent is extended or adjusted under 35 U.S.C. 154(b) by 51 days.

(21) Appl. No.: 13/507,994

(22) Filed: Aug. 13, 2012

(65) Prior Publication Data

US 2013/0040786 A1 Feb. 14, 2013

Related U.S. Application Data

(63) Continuation-in-part of application No. 13/136,623, filed on Aug. 8, 2011, now abandoned.

(51) Int. Cl.

| | |
|---|---|
| ***A63B 5/22*** | (2006.01) |
| ***A63B 5/20*** | (2006.01) |
| *A63B 71/06* | (2006.01) |

(52) U.S. Cl.

CPC ... *A63B 5/20* (2013.01); *A63B 5/22* (2013.01); *A63B 2071/0625* (2013.01); *A63B 2220/17* (2013.01)

(58) Field of Classification Search

CPC .. A63B 5/20; A63B 5/205; A63B 2071/0625; A63B 2220/17

USPC ..... 482/44–51, 78, 81, 82, 121, 126; 463/47.5, 47.6; 473/424; 434/247

See application file for complete search history.

(56) References Cited

U.S. PATENT DOCUMENTS

| | | | | |
|---|---|---|---|---|
| 3,074,717 | A * | 1/1963 | Lutz | 482/81 |
| 3,118,666 | A * | 1/1964 | Fitch | 482/81 |
| 3,493,229 | A * | 2/1970 | Ramsey | 482/81 |
| 4,135,713 | A * | 1/1979 | Martin | 482/81 |
| 4,262,898 | A * | 4/1981 | Lee | 482/49 |
| 4,605,219 | A * | 8/1986 | Mahana et al. | 482/82 |
| 4,729,560 | A * | 3/1988 | Cho | 482/82 |
| 5,062,628 | A * | 11/1991 | Heyn et al. | 482/81 |
| 5,538,454 | A * | 7/1996 | Kessler | 446/236 |
| 5,690,592 | A * | 11/1997 | Heinrich | 482/82 |
| 5,895,341 | A * | 4/1999 | Jones | 482/81 |
| 6,752,747 | B2 * | 6/2004 | Yu | 482/110 |
| 8,113,999 | B2 * | 2/2012 | Falter | 482/148 |
| 8,177,694 | B1 * | 5/2012 | Walker | 482/126 |
| 2004/0266593 | A1 * | 12/2004 | Schwendeman | 482/140 |
| 2005/0192164 | A1 * | 9/2005 | Epstein | 482/83 |
| 2006/0110716 | A1 * | 5/2006 | Micari et al. | 434/253 |

* cited by examiner

*Primary Examiner* — Loan H Thanh
*Assistant Examiner* — Gregory Winter
(74) *Attorney, Agent, or Firm* — Mark E. Pochal

(57) ABSTRACT

A jump hoop device is provided to assimilate all benefits of a conventional jump rope without use of rope which can become entangled in a user's feet or become worn with frequent use. The present jump hoop device is especially beneficial towards improvement in the areas of exercise, fitness, therapy, rehabilitation and sports training or for enjoyment at home by both children and adults. The apparatus of the invention provides quick and easy adjustment in height and width by an improved adjustment means which does not require use of bolts, pins, nuts or other means. The present apparatus can be used as a double hoop assembly providing double jumping per rotation or as a single hoop assembly like the conventional jump rope. A counter device and means of providing music or other sound recordings are attached to a pair of handle assemblies respectfully, for providing added entertainment or instructional purposes.

7 Claims, 9 Drawing Sheets

JUMP HOOP DEVICE

PRIORITY CLAIM

This application claims priority to and is a continuation-in-part of application Ser. No. 13/136,623 entitled a jump hoop device and filed on Aug. 8, 2011.

BACKGROUND OF THE INVENTION

1. Field of the Invention

The present invention relates to an improved exercise and amusement apparatus and more particularly a skipping or jumping device simulating a skip rope providing multiple skipping revolutions controlled by the hands of the user. The present invention further comprises of a counter device attached to a first handle of the jump hoop device for recording the number of skipping revolutions and a means for playing music or other sound recordings attached to a second handle for added enjoyment of the jumping device.

2. Description of the Prior Art

It is well known in the prior art that skipping rope is a popular means of amusement for children as well as providing a means for exercising and further rehabilitative/therapeutic benefits for both children and adults that have sustained debilitative injuries or illnesses.

Expert coaches, trainers, strength and conditioning professionals and competitive athletes are known to utilize jump rope exercises in their training because of the unparalleled cardiovascular workout benefits. Additionally, jump rope exercises utilize all major muscle groups of the entire body resulting in improvements in agility, hand-eye-foot coordination, vertical jumping ability and hand-foot speed.

A search of the prior art reveals several patents that disclose a hoop apparatus for simulating a jump rope. Several of these prior art patents disclose a crank mechanism to operate these devices. Representative of this type of construction are: U.S. Pat. No. 4,022,462 to Pena-Kipper; U.S. Pat. No. 4,184,677 to Murray; UK Patent GB 2249488 to Leitner; U.S. Pat. No. 169,625 to Crandall; and, U.S. Pat. No. 3,118,666 to Fitch. Disadvantages of this construction, which are addressed in the present invention, are the difficulty of the user in maneuvering while jumping in place, running forward or going backwards and the limitation of a fixed breadth adjustment.

Other prior art patents disclose a center crossbar used as the axis for rotating the hoop device. Representative of this type of construction are: U.S. Pat. No. 5,062,628 to Heyn et al.; U.S. Pat. No. 4,315,623 to Granderson; U.S. Pat. No. 3,958,802 to Thornton; U.S. Pat. No. 3,072,402 to McCombs; and, U.S. Pat. No. 3,064,972 to Feinn. The disadvantage of this construction is wrist fatigue caused during rotation of the center crossbar.

Further prior art patents disclose rope ends attached to the outer terminal ends of the leg members. Representative of this type of construction are: U.S. Pat. No. 5,234,393 to Heinrich; U.S. Pat. No. 4,184,677 to Murray; U.S. Pat. No. 5,236,405 to Dohmann et al.; U.S. Pat. No. 5,690,592 to Henrich; and U.S. Pat. No. 3,064,972 to Feinn. The disadvantages of this construction is the problem of the user's feet becoming entangled in the rope ends because of the difficulty in controlling and maintaining the rope's momentum and fraying of the rope with repeated use.

Further prior art patents disclose rectangular shape hoops versus elliptical shape hoops. Representative of this construction are: U.S. Pat. No. 3,072,402 to McCombs; and, U.S. Pat. No. 3,958,802 to Thornton. The disadvantage of this construction is the minimal space provided for the user to jump through the hoop compared to an elliptical shape hoop making the use of these devices more difficult, In view of the foregoing noted disadvantages of the prior art skipping hoop devices, it should be apparent that there exists a need in the art of skipping hoop devices for improvements that enhance the amusement and enjoyment of the user as well as increasing the degree of exercise benefits.

SUMMARY OF THE INVENTION

The present invention relates to a jump hoop device capable of being used as a double hoop device providing double skipping per revolution or a single hoop used like a conventional jump rope. The jump hoop device comprises a plurality of interconnected hoop members forming a continuous elliptically shaped hoop apparatus when connected to a plurality of extruder extension rods. The extruder extension rods having along their axis a series of holes for means of adjustment within the hoop members to accommodate varying sizes of the user. A pair of equally opposed handle assemblies are attached to the extension rods providing a means for rotation of the hoop apparatus by swiveling of the handle assemblies.

A principal object of this invention is to provide all the benefits of a conventional jump rope without the use of a rope component making this invention safer to the user eliminating entanglement of the rope component with the user's feet.

A further object of this invention is to provide a durable jump hoop device providing durable Interconnection of the hoop members and a durable interlocking means to the handle assembly and to the adjustment rods providing a durable frame at all height and width adjustments.

A further object of this invention is to provide a double hoop assembly having interconnected opposing elliptical hoop members or use as a single hoop assembly.

A further object of this invention is the ease of assembly and disassembly into a plurality of parts requiring minimal storage space and ideal for traveling.

A further object of this invention is the minimal cost in manufacturing. A further object of this invention is the continuous hoop assembly eliminating any exposed member ends which are potentially a safety concern.

A further object of this invention is the improved handle assembly providing ease in the rotation of the jump hoop assembly while providing a secure attachment to the extension rods assimilating the use of a conventional jump rope.

A further object of this invention is a jump hoop device that is assembled without the need of screws, bolts, nuts or other means allowing quick and easy assembly and providing a securely fitted device.

A further object of this invention is a jump hoop device that allows the user to fully control the speed from a very slow rotation (especially good for beginners or for rehabilitation/therapy) to that of very fast (for advanced users).

A further object of this invention is to provide a jump hoop device having a sound mechanism within one leg hoop member to aid a visual impaired user for timing/foot coordination of one's jumping when used as a single or double hoop configuration or added amusement for the youth.

A further object of this invention is to provide a counter device to record the number of skipping revolutions completed by the user. This is useful to assist in the use of the jump hoop device as a training device or to mark progress when used as for rehabilitation or therapy purposes. Additionally, the counter device enhances the amusement of the jump hoop device as multiple users may compete with one another as to the greatest number of revolutions for a defined period of time.

A further object of this invention is to provide a means for playing music or other sound recordings during use of the jump hoop device. The user may jump in synch with the tempo or rhythm of the music of choice improving one's coordination while adding to the enjoyment of the jump hoop device. The means for playing music or other sound recordings may be changed or adapted to the preferences of the user.

BRIEF DESCRIPTION OF THE DRAWING

The invention will be better understood and objects other than those set forth above will become apparent when consideration is given to the following detailed description thereof. Such description makes reference to the annexed drawings wherein.

DETAILED DESCRIPTION OF PREFERRED EMBODIMENT

Figure 1:
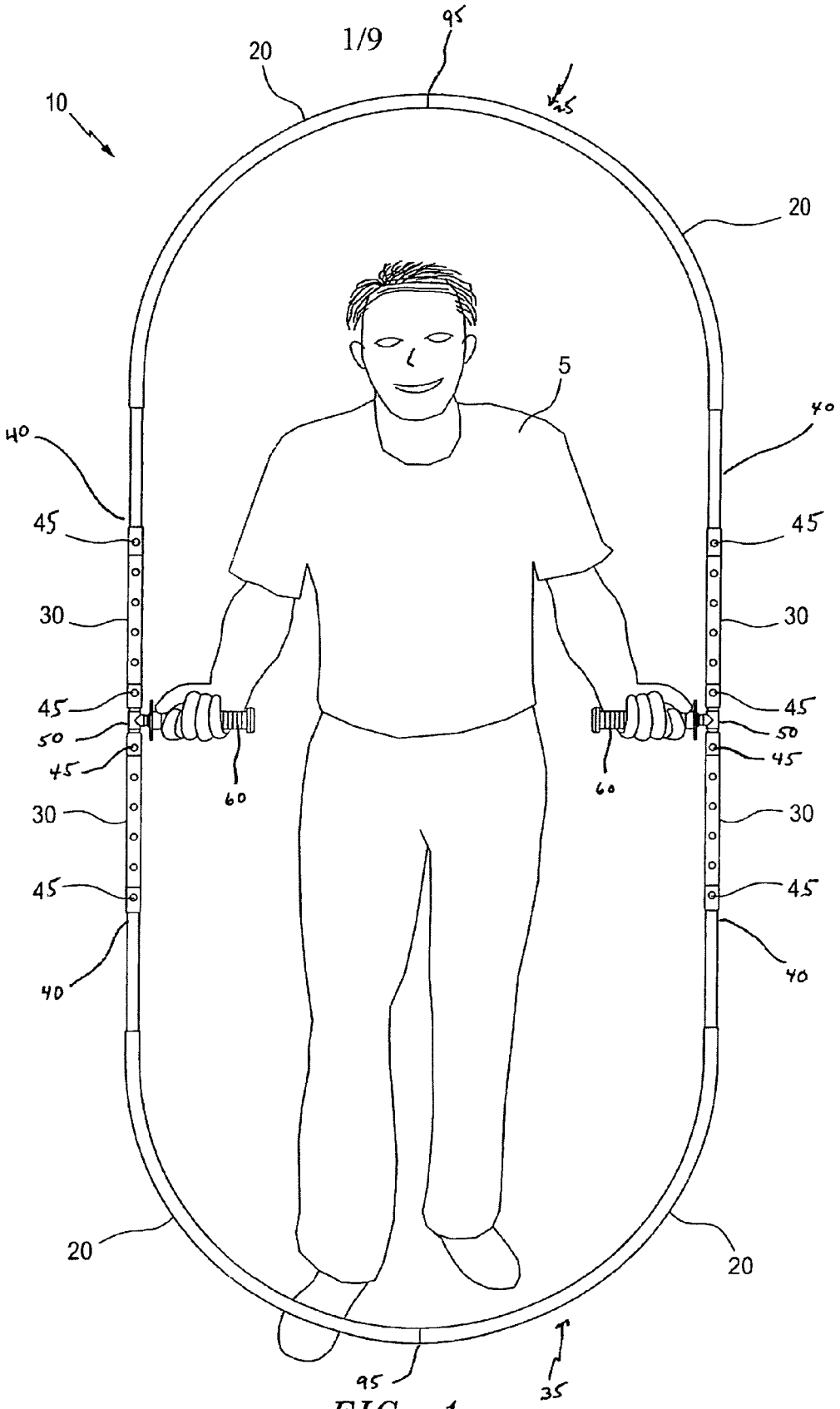
FIG. 1 is a front view of the interconnected opposing elliptical hoop members to the height extension rods and opposing handles forming a continuous double hoop jump skipping device.

Referring now in detail to the drawing illustrated in FIG. 1, a jump hoop assembly (10) comprising a double hoop embodiment is reference by numeral (10). Jump hoop assembly (10) is comprised of a plurality of elliptically shaped hoop members (20) symmetrically opposed and connected at a first end by a pressure fit (95) to form a first leg member (25) and a second leg member (35).

In the preferred embodiment, as illustrated in FIG. 1, attached at a second terminal end of said hoop members (20) is a lock stop means (40) comprising a spring pressure button (45) positioned within the terminal end hoop members (20) which when aligned with holes aligned within a axis of a pair of horizontally opposed extruder extension rods (30) release within said holes creating a firm connection.

The extruded extension rods (30) contain equally spaced series of holes of graduating indicia for providing adjustments in height of the hoop members (20). Adjustments in height are effected by sliding hoop member (20) along extruder extension rods (30) of said first leg member (25) and second leg member (35) to an equally opposed selected hole causing release of said spring pressure button (45) of lock stop means (40) within said selected hole.

The first leg member (25) and second leg hoop member (35) are connected to form jump hoop assembly (10) by a connection means (50) to opposing handle grip assembly (60).

Figure 2:
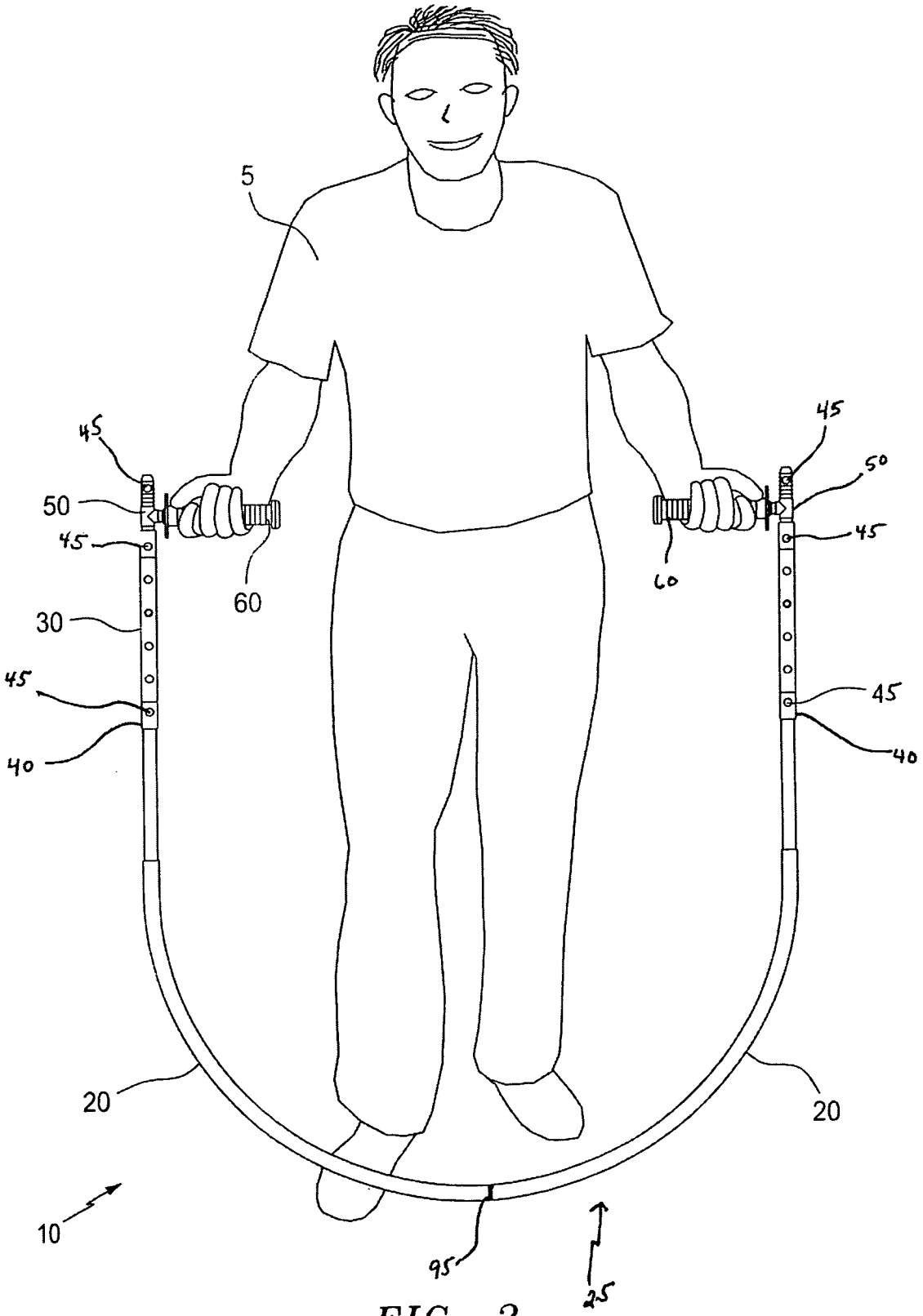
FIG. 2 is illustrative of user (5) activating leg member (25) alone. In this preferred embodiment, leg member (25) is connected to said first end of perpendicular arm (75) of T-connector (52) by detent (45).

FIG. 2. Is illustrative of user (5) utilizing one leg hoop member (25) attached to extruder extension rod (30) by lock stop device (40) at the terminal end of hoop member (20). The adjustments of leg hoop member (25) are made by sliding hoop members (20) along said extruder extension rods (30) to said selected opening along extruder extension rods (30) engaging lock stop device (40) as described above. Said pair of opposed handle assembly (60) are attached to extruder extension rods (30) by said connecting means (50).

Figure 4:
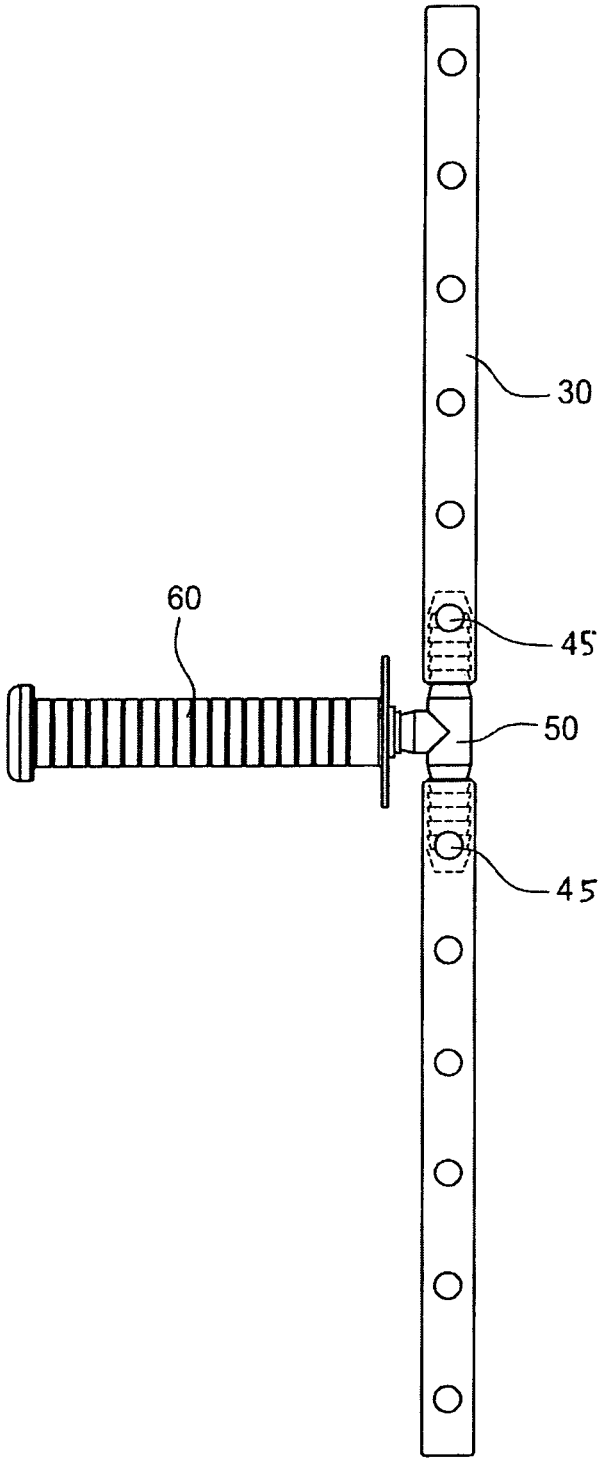
FIG. 4 is an isolated view of the extension rods illustrating the series of holes along their axis for a plurality of height adjustments and the fastening means of the handle assembly.
Figure 5:
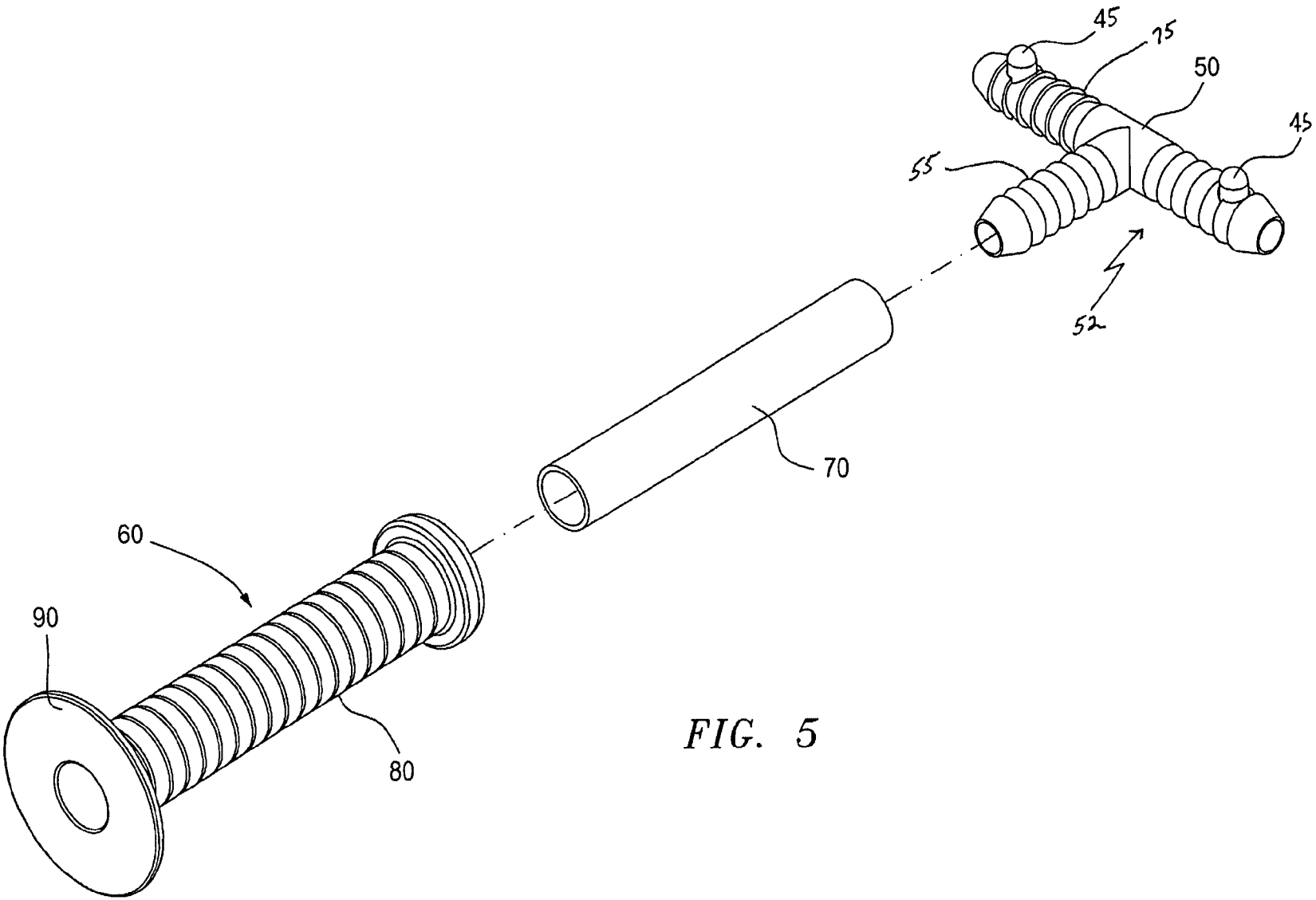
FIG. 5 is a isolated view of the handle assembly and means of attachment to the extension rod.

Referring to FIGS. 4 and 5 the handle assembly (60) and the connection means (50) to extension rods (30) are Illustrated. Handle assembly (60) comprises an outer hollow handle grip (80) having a flange (90) at a first end. An inner sleeve (70) is positioned within said handle grip (80) with a first end of inner sleeve (70) abutting flange (90). A conical tapered T-connector (52) having a transverse arm (55) connected with a second end of inner sleeve (70). A perpendicular arm (75) of T-connector (52) is attached to extruder extension rods (30) at a first and second opposing ends by a connecting means (50).

Referring to FIG. 5, the connecting means (50) is illustrated as comprised of a plurality of detents (45) located symmetrically opposed on said first and second ends of perpendicular arm (75). Detents (45) when compressed to an unlocked position allow for quick disassembly. Detents (45) when abutted through a selected hole of extension rods (30) engage to a locked position. Handle assembly (60) in the locked position to extension rods (30) form said jump hoop assembly (10). In a preferred embodiment, inner sleeve (70) contains a lubricating substance or other means providing more ease in a swivel action of the jump hoop assembly (10) when activated by user (5) gripping handle assembly (60).

FIGS. 2 & 5 are illustrative of user (5) activating leg member (25) alone. In this preferred embodiment, leg member (25) is connected to said first end of perpendicular arm (75) of T-connector (52) by detent (45).

Figure 3:
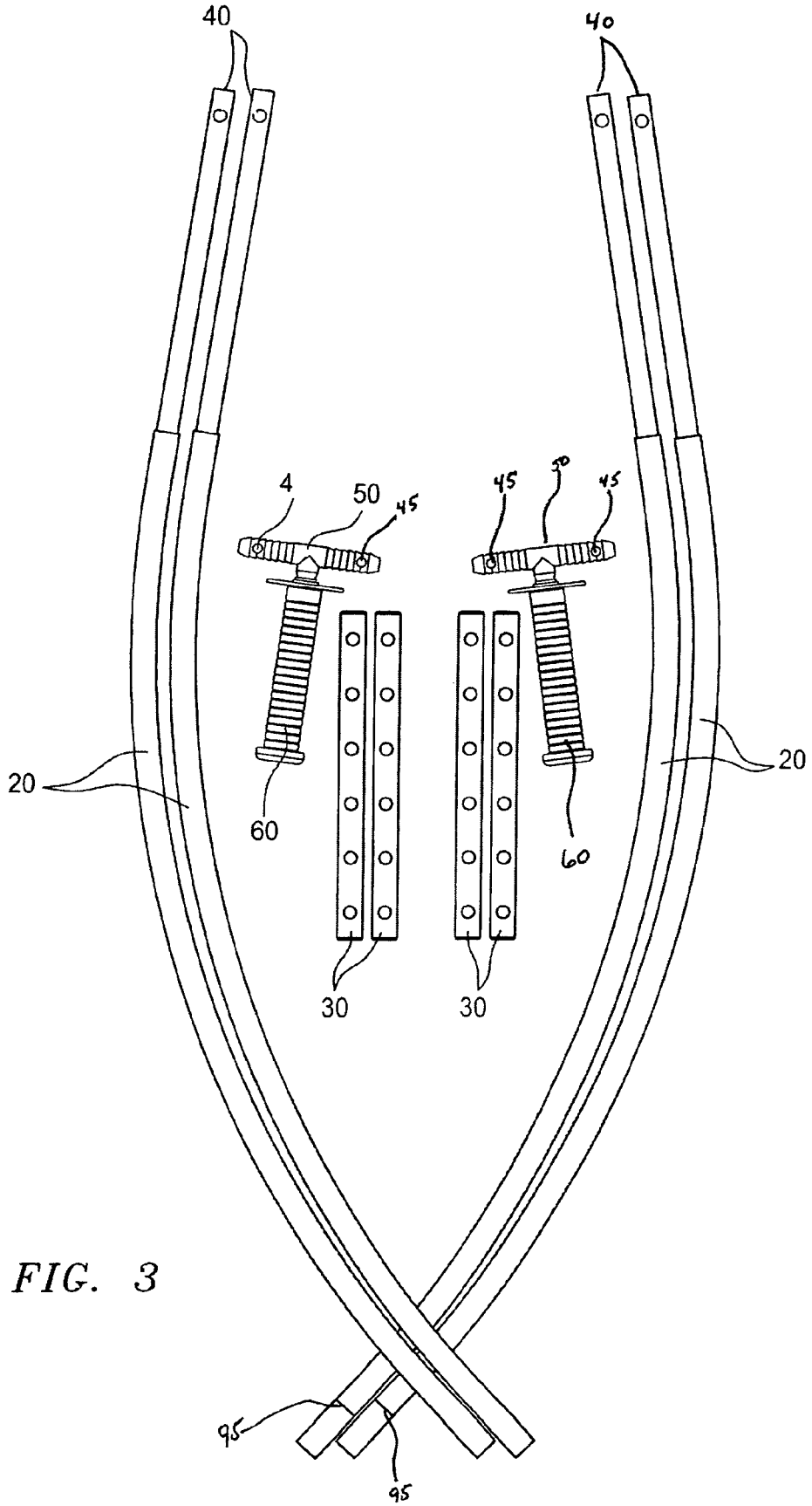
FIG. 3 is a view of the jump hoop assembly disassembled into its component parts.

Referring to FIG. 3, it is illustrated the jump hoop device (10) disassembled into component parts: elliptical hoop members (20); extruder extension rods (30); and, handle grip assembly (60). Jump hoop device (10) is disassembled by disengagement of said lock stop (40) and detents (45) of connector means (50) and release of elliptical hoop members (20) at said pressure fit (95).

Figure 6:
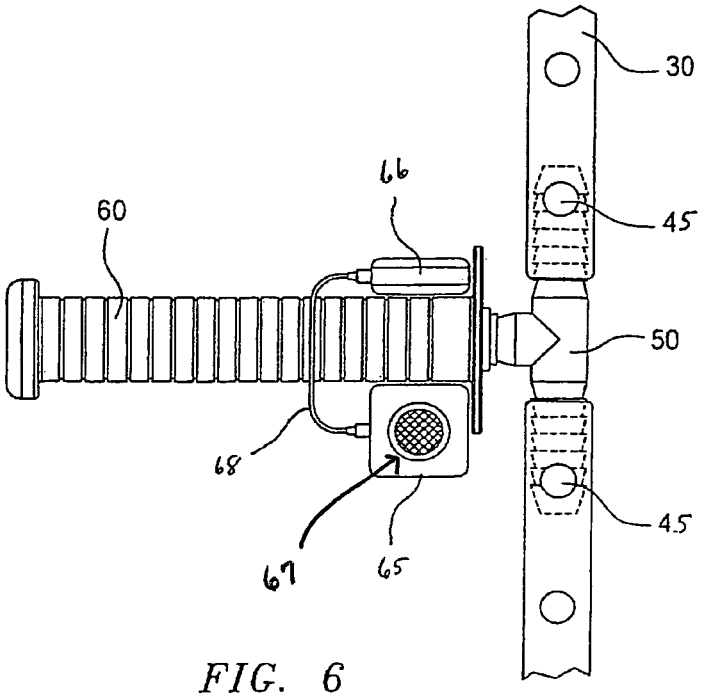
FIG. 6 is illustrative of a means for playing music or other sound recordings attached to the handle grip assembly (60) at the end attached to connector means (50). The means for playing music or other sound recordings comprises a speaker device and recorder device (67) attached on a first side of handle grip assembly (60) and a power source (66) attached to a second opposite side of handle grip assembly (60). The speaker device (65) is connected to the power source by a connector wire (68).

FIG. 6 is illustrative of a means for playing music or other sound recordings attached to the handle grip assembly (60) at the end attached to connector means (50). The means for playing music or other sound recordings comprises of a speaker device (65) attached on a first side of handle grip assembly (60) and a power source (66) attached to a second opposite side of handle grip assembly (60). The speaker device (65) is connected to the power source (66) by a connector wire (68).

Figure 7:
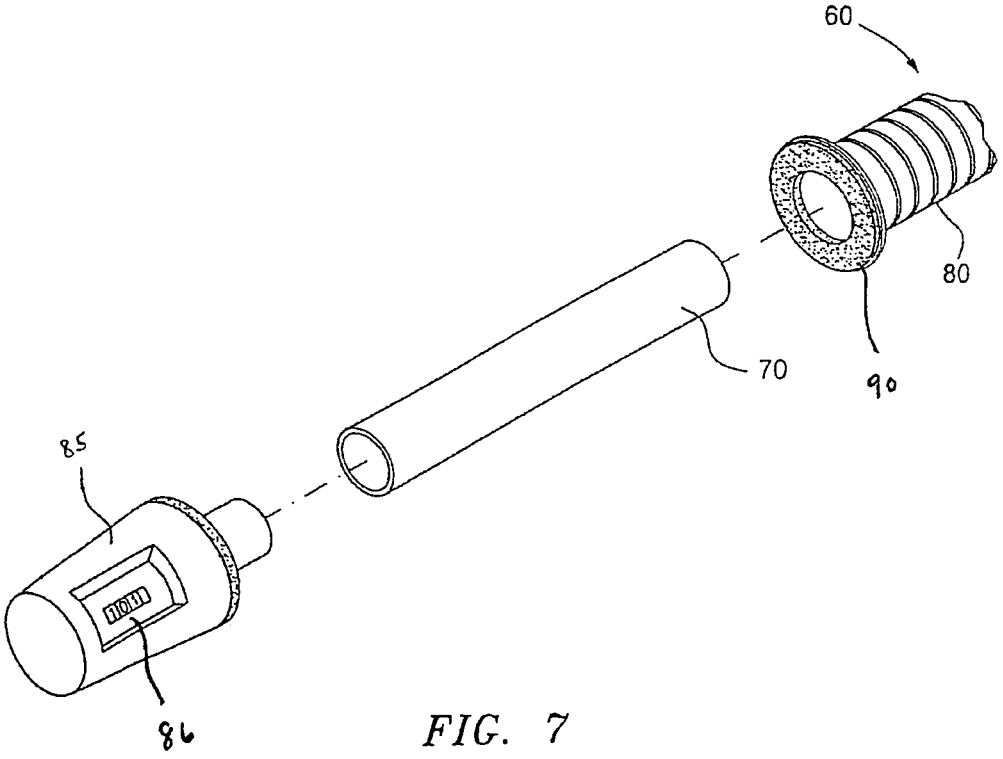
FIG. 7 is an isolated view of the counter device and attachment means to the end of the handle of the jump hoop device.

FIG. 7. Is illustrative of the counter device (85) attached to the second opposite handle grip (60). The counter device (85) is inserted into inner sleeve (70). Counter device (85) in communication with inner sleeve (70) is positioned within handle grip assembly (80) to a point at which counter device (85) abuts flange (90) of handle grip (80). As revolution of the jump hoop device (10) are performed, inner sleeve (70) rotates within handle grip (80) resulting in counter device (85) to rotate and simultaneously increasing the numerical display (86) of counter device (85) a digit per revolution.

Figures 8, 9:
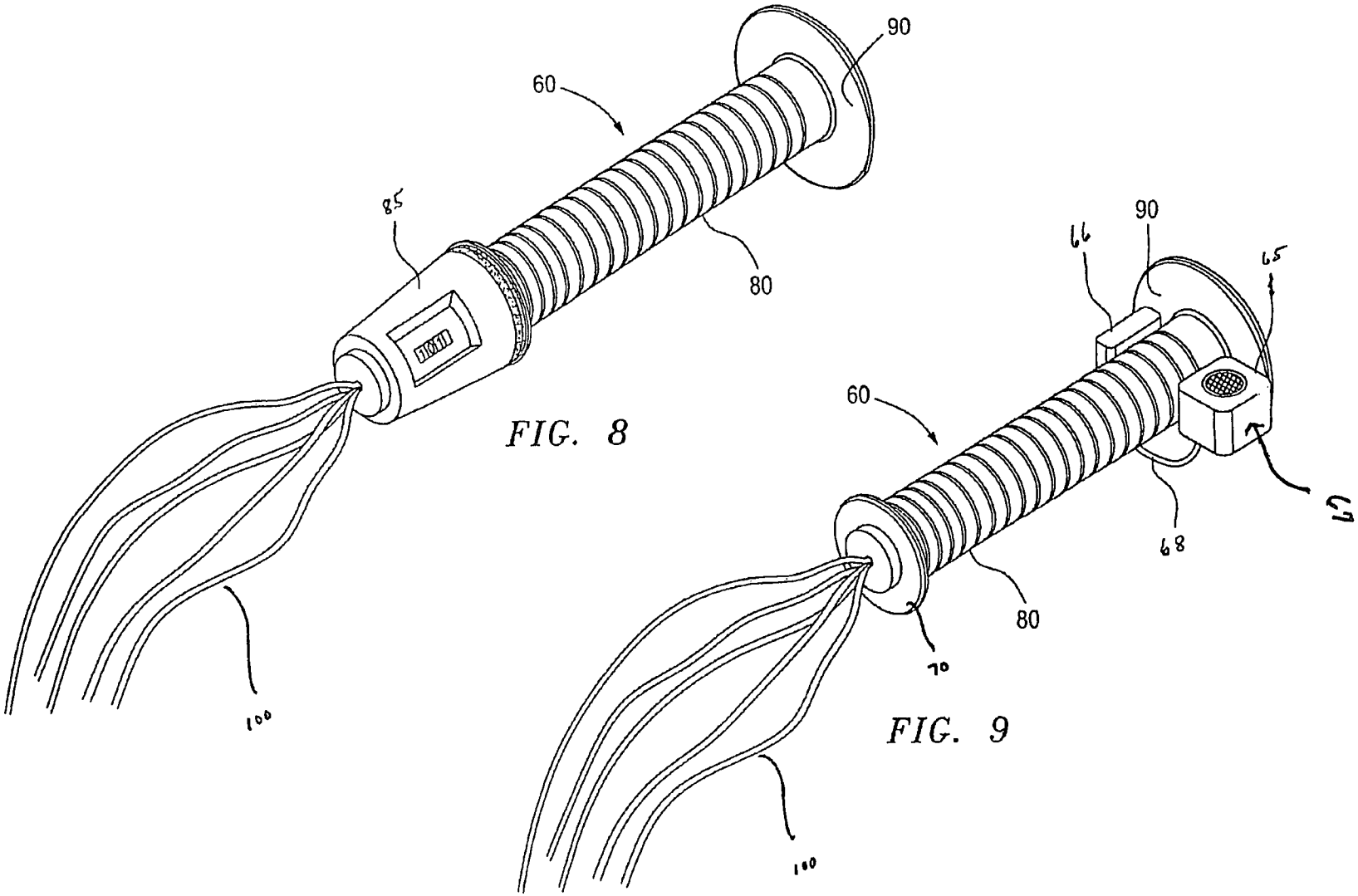
FIG. 8 is a view of the counter device attached to the handle of the jump hoop device with decorative materials extending from the counter device.
FIG. 9 is a view of the means for playing music or other sound recordings attached to one end of the handle of the jump hoop device and decorative materials extending from the second distal end of the jump hoop device.

FIGS. 8 & 9 depict a preferred embodiment of the counter device (85) and the means for playing music or other sound recordings (65, 66, &68) attached to the first and second handles (60). Additionally, decorative materials (100) are inserted in the free end of counter device (85) and flange (70) of the second handle (60).

Figure 10:
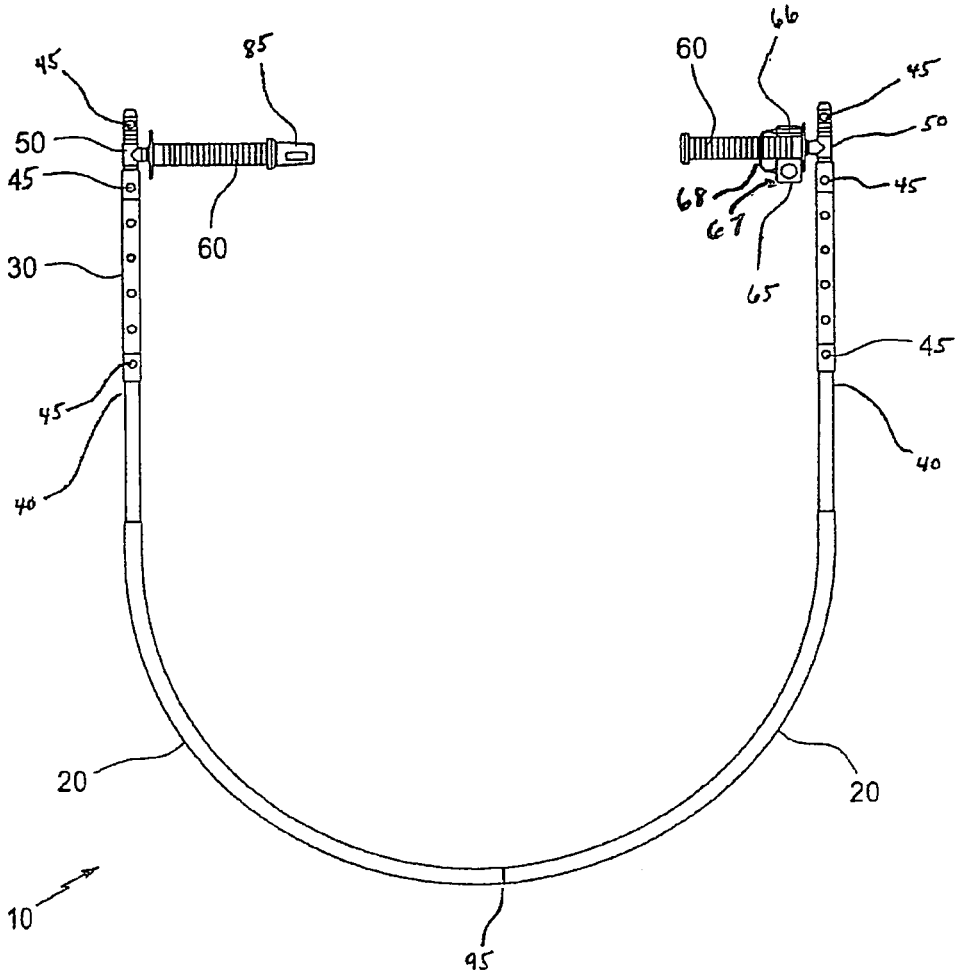
FIG. 10 is a view of the counter device and means for playing music or other sound recordings attached to the first and second opposite handles, respectfully, of single hoop embodiment.
Figure 11:
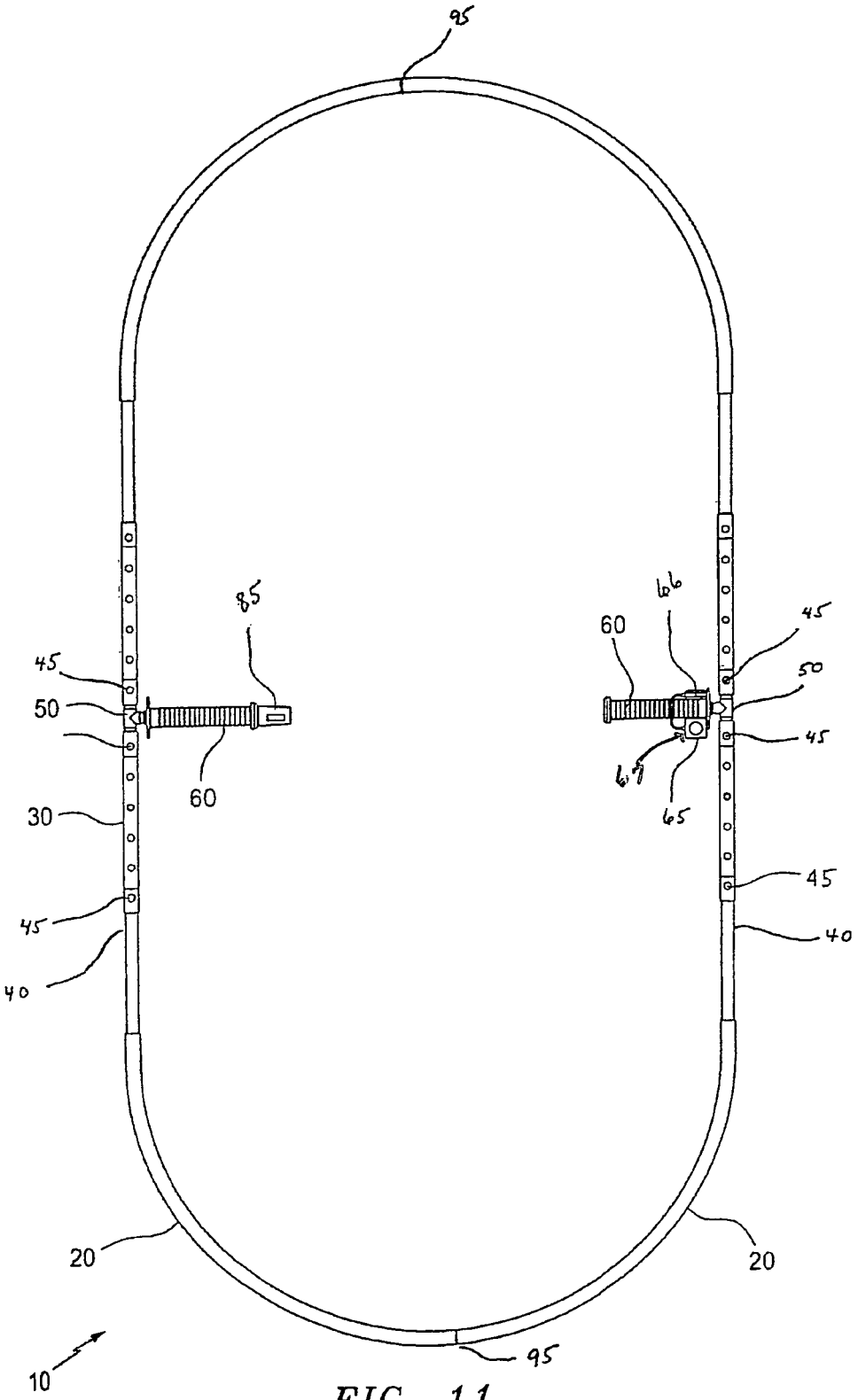
FIG. 11 is a view of the counter device and means for playing music or other sound recordings attached to the first and second opposite handles, respectfully, of a double hoop embodiment.

Counter device (85) and means for playing music or other sound recordings (65, 66, & 68) are functional when either using a single hoop or double hoop embodiment as illustrated in FIGS. 10 & 11 respectfully.

What is claimed is:

1. A jump hoop assembly comprising:

a first and second pair of flexible hoop members connected at a first end of each individual hoop member to the other hoop member in its pair by a pressure fit forming a symmetrically opposed first and second semi-elliptically shaped leg hoop members, said first and second leg hoop member having opposing terminal ends containing a hole housing a pair of lock stop devices proximal to a first and second extruder extension rods, said extension rods having a longitudinal axis containing a plurality of spaced holes and connected at said terminal ends of each first and second leg hoop members by said lock stop devices forming a continuous elliptical jump hoop assembly, said extruder extension rods capable of passing over said first and second leg hoop members and engaging said lock stop devices when in communication with a selected hole of the plurality of spaced holes for alternate height adjustments; and first and second opposed handle assemblies having an outer hollow handle grip with a flange at one end, a hollow inner sleeve having a first end inserted within said outer hollow handle grip and abutting the flange, and a conical tapered T-connector having a transverse arm inserted within a second end of the inner sleeve and a horizontal arm, said T-connector attached to the extruder extension rods by a pair of detents contained within the opposing first and second ends of the T-connector horizontal arm, said detents adapted to a locked position when in communication with said plurality of spaced holes positioned on said extruder extension rods, said handle assemblies providing transverse rotation of the jump hoop assembly by means of rotation of said handle assemblies.

2. The jump hoop assembly of claim 1, wherein said means of rotation of said handle assemblies comprises:

a lubricating substance applied to said inner sleeve reducing resistance and accommodating rotation when positioned within said outer hollow grip.

3. The jump hoop assembly as set forth in claim 1 wherein the lock stop device comprises:

a release element consisting of a release button in communication with a compression spring engaging said release button when aligned with said hole of said plurality of spaced holes along the longitudinal axis of said extruder extension rod.

4. A jump hoop assembly comprising:

a first and second flexible hoop member symmetrically opposed and connected at a first end by a pressure fit forming a semi-elliptical leg hoop member; said semi-elliptical leg hoop member having opposing terminal ends containing a hole housing a pair of lock stop devices proximal to a first and second juxtaposed extruder extension rods having a longitudinal axis containing a plurality of spaced holes and connected at said terminal ends by said lock stop devices, said extruder extension rods capable of passing over said leg hoop member and engaging said lock stop devices when in communication with a selected hole of the plurality of spaced holes for alternate height adjustments; and first and second opposed handle assemblies having an outer hollow handle grip with a flange at one end, a hollow inner sleeve having a first end inserted within said outer hollow handle grip and abutting the flange, and a conical tapered T-connector having a transverse arm inserted within a second end of the inner sleeve and a horizontal arm, said T-connector attached to the extruder extension rods by a pair of detents contained within the opposing first and second ends of the T-connector horizontal arm, said detents adapted to a locked position when in communication with said plurality of spaced holes positioned on said extruder extension rods, said handle assemblies providing transverse rotation of the jump hoop assembly by means of rotation of said handle assemblies.

5. The jump hoop assembly of claim 4, wherein said means of rotation of said handle assemblies comprises:

a lubricating substance applied to said inner sleeve reducing resistance and accommodating rotation when positioned within said outer hollow grip.

6. A jump hoop assembly comprising:

a first and second pair of flexible hoop members connected at a first end of each individual hoop member to the other hoop member in its pair by a pressure fit forming symmetrically opposed first and second semi-elliptically shaped leg hoop members, said first and second leg hoop members having opposing terminal ends containing a hole housing a pair of lock stop devices proximal to first and second juxtaposed extruder extension rods containing a plurality of spaced holes and connected at said terminal ends of each first and second leg hoop members by said lock stop devices forming a continuous elliptical jump hoop assembly, said extruder extension rods capable of passing over said first and second leg hoop members and engaging said lock stop devices when in communication with a selected hole of the plurality of spaced holes for alternate height adjustments; first and second opposed handle assemblies having an outer hollow handle grip with a flange at one end, a hollow inner sleeve having a first end inserted within said outer hollow handle grip and abutting the flange, and a conical tapered T-connector having a transverse arm inserted within a second end of the inner sleeve and a horizontal arm, said T-connector attached to the extruder extension rods by a pair of detents contained within the opposing first and second ends of the T-connector horizontal arm, said detents adapted to a locked position when in communication with said plurality of spaced holes positioned on said extruder extension rod, said handle assemblies providing transverse rotation of the jump hoop assembly by means of rotation of said handle assemblies; a counter device attached to said first handle assembly, said counter device having a digital numerical display for recording revolutions of the first handle; and a means for playing music attached to said second handle assembly.

7. A jump hoop assembly comprising:

a first and second flexible hoop member symmetrically opposed and connected at a first end by a pressure fit forming a semi-elliptical leg hoop member; said semi-elliptical leg hoop member having opposing terminal ends containing a hole housing a pair of lock stop devices proximal to first and second juxtaposed extruder extension rods containing a plurality of spaced holes and connected at said terminal ends by said lock stop devices, said extruder extension rods capable of passing over said leg hoop member and engaging said lock stop devices when in communication with a selected hole of the plurality of spaced holes for alternate height adjustments; and first and second opposed handle assemblies having a means for connection having an outer hollow handle grip with a flange at one end, a hollow inner sleeve having a first end inserted within said outer hollow handle grip abutting the flange, and a conical tapered T-connector having a transverse arm inserted within a second end of the inner sleeve and a horizontal arm, said T-connector attached to the extruder extension rods by a pair of detents contained within the opposing first and second ends of the T-connector horizontal arm, said detents adapted to a locked position when in communication with said plurality of spaced holes positioned on said extruder extension rods, said handle assemblies providing transverse rotation of the leg hoop member by means of rotation of said handle assemblies; a counter device attached to said first handle assembly, said counter device having a digital numerical display for recording revolutions of the first handle; and a means for playing music attached to said second handle assembly.

* * * * *